US006247979B1

(12) United States Patent
Rigby

(10) Patent No.: US 6,247,979 B1
(45) Date of Patent: Jun. 19, 2001

(54) INBOARD/OUTBOARD BOAT DRIVE

(75) Inventor: Gary Rigby, Booral (AU)

(73) Assignee: DBD Marine Pty. Ltd., Newcastle (GB)

( * ) Notice: Subject to any disclaimer, the term of this patent is extended or adjusted under 35 U.S.C. 154(b) by 0 days.

(21) Appl. No.: 09/135,865

(22) Filed: Aug. 18, 1998

(30) Foreign Application Priority Data

Aug. 20, 1997 (AU) ..... PO8696
Apr. 7, 1998 (AU) ..... PP2855

(51) Int. Cl.[7] ..... B63H 5/125
(52) U.S. Cl. ..... 440/57; 440/83; 440/53
(58) Field of Search ..... 440/53, 57, 60, 440/61, 79–83

(56) References Cited

U.S. PATENT DOCUMENTS 4,645,463 * 2/1987 Arneson ..... 440/57
4,976,638 * 12/1990 Grinde ..... 440/83
5,167,548 * 12/1992 Thiger ..... 440/53
5,421,754 * 6/1995 Lund-Anderson ..... 440/57

FOREIGN PATENT DOCUMENTS

0407630 * 1/1991 (EP) ..... 440/57

* cited by examiner

*Primary Examiner*—Ed Swinehart
(74) *Attorney, Agent, or Firm*—Ladas & Parry

(57) ABSTRACT

An inboard/outboard boat drive having a housing with first and second ends and a cavity passing between the housing first and second ends. The first end of housing is pivotally mounted on the boat stern. The drive includes an input drive shaft for coupling to an engine mounted within the boat, an intermediate drive shaft disposed within the housing cavity, a first universal joint coupling the input device shaft and the intermediate drive shaft, together with an output drive shaft coupled to a propulsion element and a second universal joint coupling the intermediate drive shaft and the output drive shaft.

10 Claims, 4 Drawing Sheets

INBOARD/OUTBOARD BOAT DRIVE

TECHNICAL FIELD

The present invention relates to a direct boat drive, and in particular to an inboard/outboard boat drive which couples an inboard engine to a propeller enabling steering and trim adjustment.

BACKGROUND OF THE INVENTION

Many boats are driven by internal combustion engines, which may be of the inboard or outboard type. Outboard engines are typically pivotally mounted on the stern of the boat allowing for steering without the need for a separate rudder, and enabling adjustment of the angle between the propeller drive and the hull for changes in boat trim. The pivotal mounting also allows boats fitted with such outboard engines to run up on to beaches with the propeller pivoted above the lower surface of the hull, preventing damage thereof.

Inboard engines are typically attached through a transmission or gearbox directly to the propeller shaft, and are necessarily mounted toward the center of the boat with a long propeller shaft to allow the propeller to minimize the drive angle between the propeller shaft and hull waterline. Such installations are necessarily bulky, and installation of the engine toward the center of the hull provides undesirable weight distribution characteristics in planing type hulls, which ideally have the heavy engine installed toward the rear of the boat.

To provide inboard engine installations with the advantages of outboard engine installations detailed above, inboard/outboard installations have been developed. These installations couple an inboard engine mounted within the hull of the boat to a drive assembly and propeller arrangement similar to that of an outboard engine installation, the engine essentially being connected through a 'leg' to the propeller. The engine can thus be mounted toward the rear of the boat, and steering and trim control provided in a compact installation.

The mechanical system through which the power is transmitted usually consists of a drive-train of complex gearing, together with a number of joint systems so as to achieve steering and a measure of trim control. Such systems are mechanically complex and intrinsically inefficient. The power which may be transmitted through such devices is limited by the physical size of the devices, requiring the use of multiple engines and drives for high performance boats.

OBJECT OF THE INVENTION

It is the object of the present invention to overcome or substantially ameliorate at least some of the above disadvantages.

SUMMARY OF THE INVENTION

There is disclosed herein an inboard-outboard boat drive comprising:

- a housing having a first end, a second end and a cavity passing between said housing first and second ends;
- pivotal mounting means for pivotally mounting said housing first end on a stern section of a boat, enabling pivotal movement about a pivot point;
- an input drive shaft having first and second ends, said first end being adapted to be coupled to an engine mounted in said boat;

- an intermediate drive shaft disposed within said cavity and having a first end towards said housing first end and a second end towards said housing second end;
- a first universal joint coupling said input drive shaft second end to said intermediate drive shaft first end, said first universal joint being disposed about said pivot point to enable pivotal movement of said intermediate drive shaft about said pivot point;
- an output drive shaft having first and second ends, said output drive shaft second end being adapted to be coupled to a propulsion element; and
- a second universal joint coupling said intermediate shaft second end to said output shaft first end.

Generally, each of said first and second universal joints is a constant velocity universal joint.

Typically said pivotal mounting means comprises a semi-spherical joint in the general form of a ball and socket arrangement.

Typically said semi-spherical joint includes:

- a semi-spherical female socket member provided at said housing first end and adapted to be fastened to said stern section, and
- a semi-spherical male ball type member disposed within said semi-spherical socket member. In such an arrangement the cavity passes through said semi-spherical male ball type member such that said first universal joint is generally concentrically positioned within said semi-spherical male ball type member and about said pivot point.

Preferably separate steering and trim control elements are mounted on said housing for steering and trim control.

Preferably said trim control element is a hydraulic ram.

Alternatively a control lever is mounted on said semi-spherical ball-type member for steering and/or trim control.

Preferably said input shaft is mounted in bearings disposed within a bearing housing fastened to, or integral with, said semi-spherical female socket member.

Preferably said output shaft is mounted in bearings disposed within said cavity towards said housing second end.

Preferably a seal is provided in said cavity at said housing second end.

BRIEF DESCRIPTION OF THE DRAWINGS

Preferred forms of the present invention will now be described by way of example with reference to the accompanying drawings wherein.

DETAILED DESCRIPTION OF THE PREFERRED EMBODIMENTS

Figure 1:
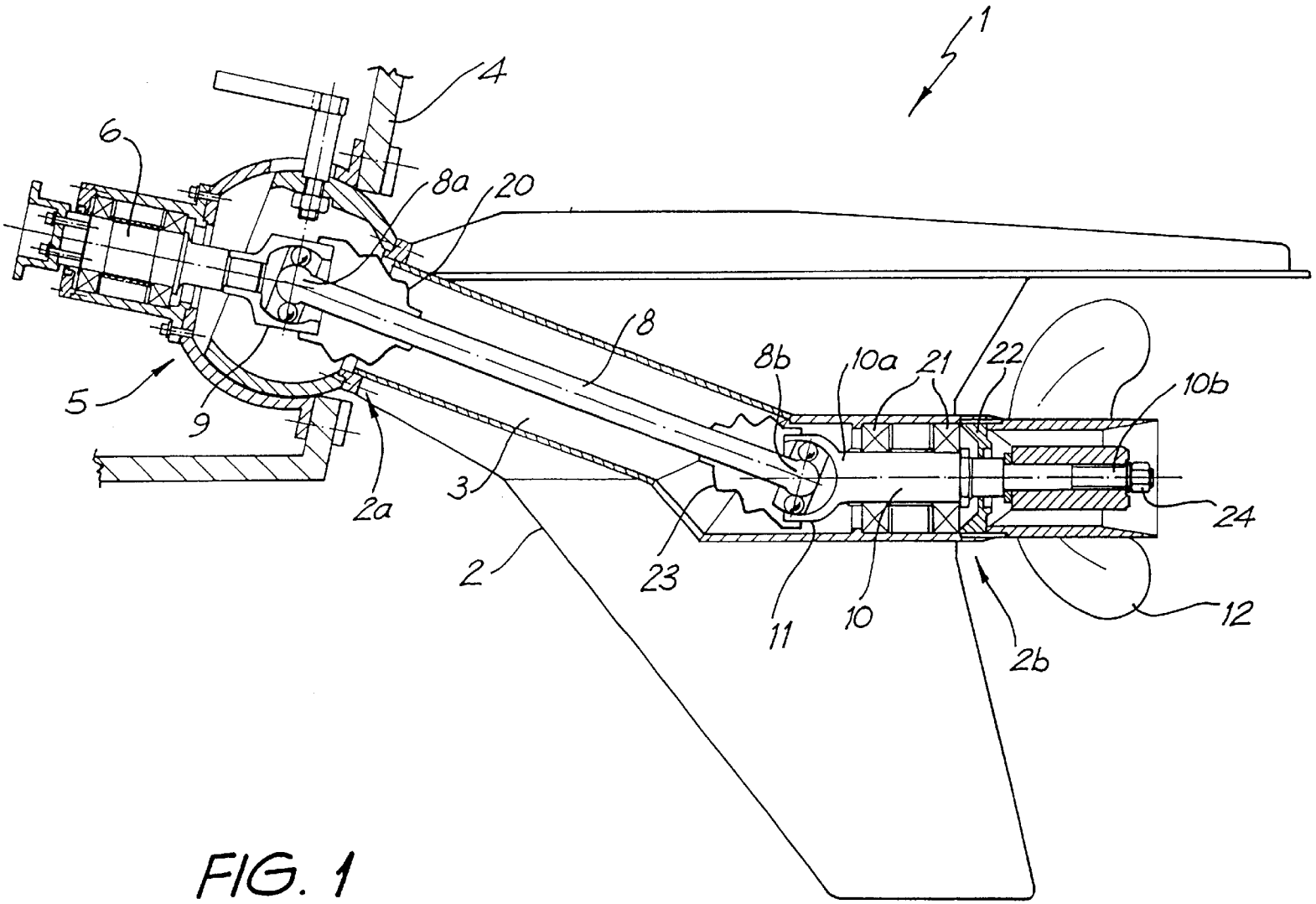
FIG. 1 is a partially sectioned side view of the inboard/outboard boat drive.
Figure 2:
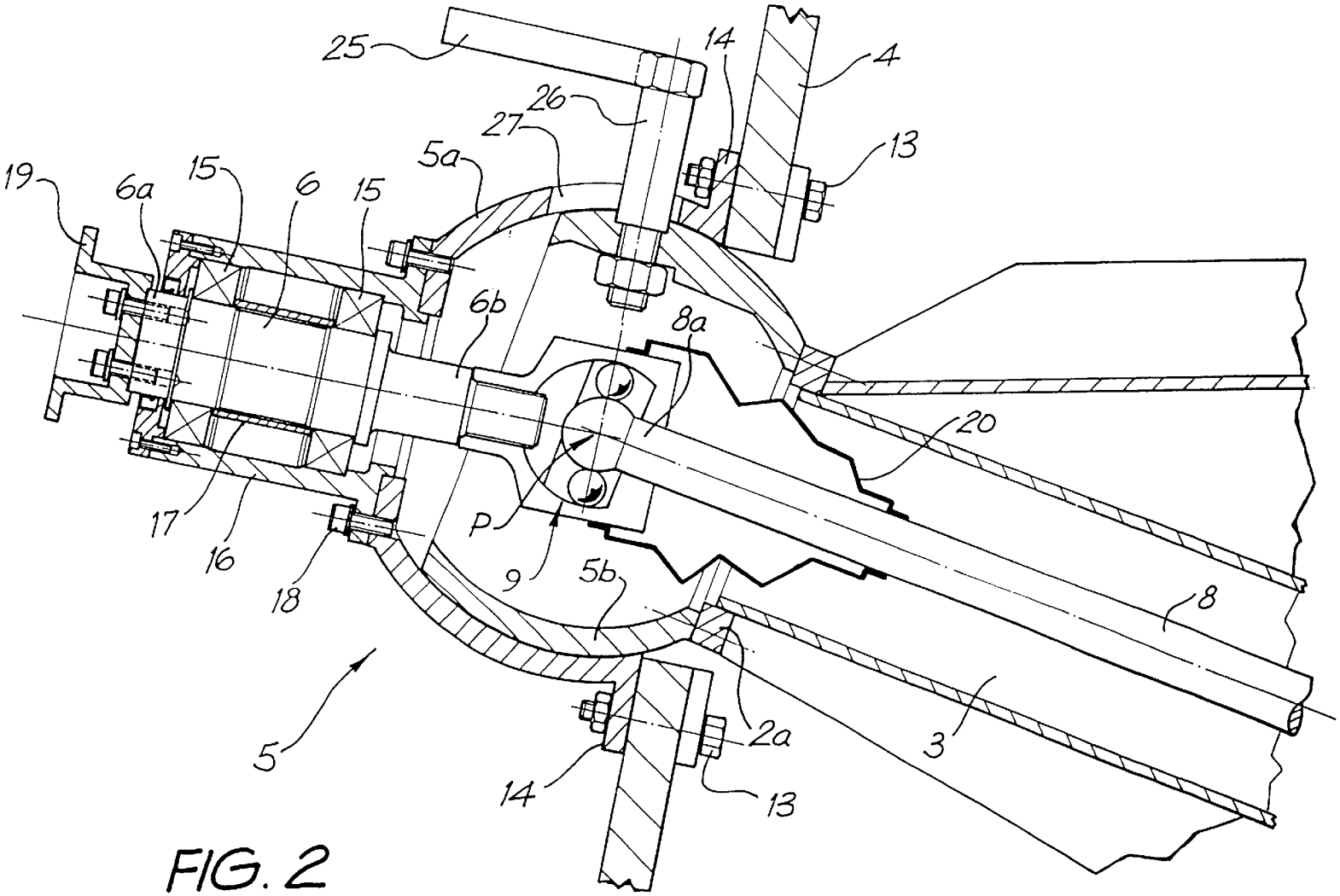
FIG. 2 is a partially sectioned side view of the semi-spherical joint of the inboard/outboard boat drive of FIG. 1
Figure 3:
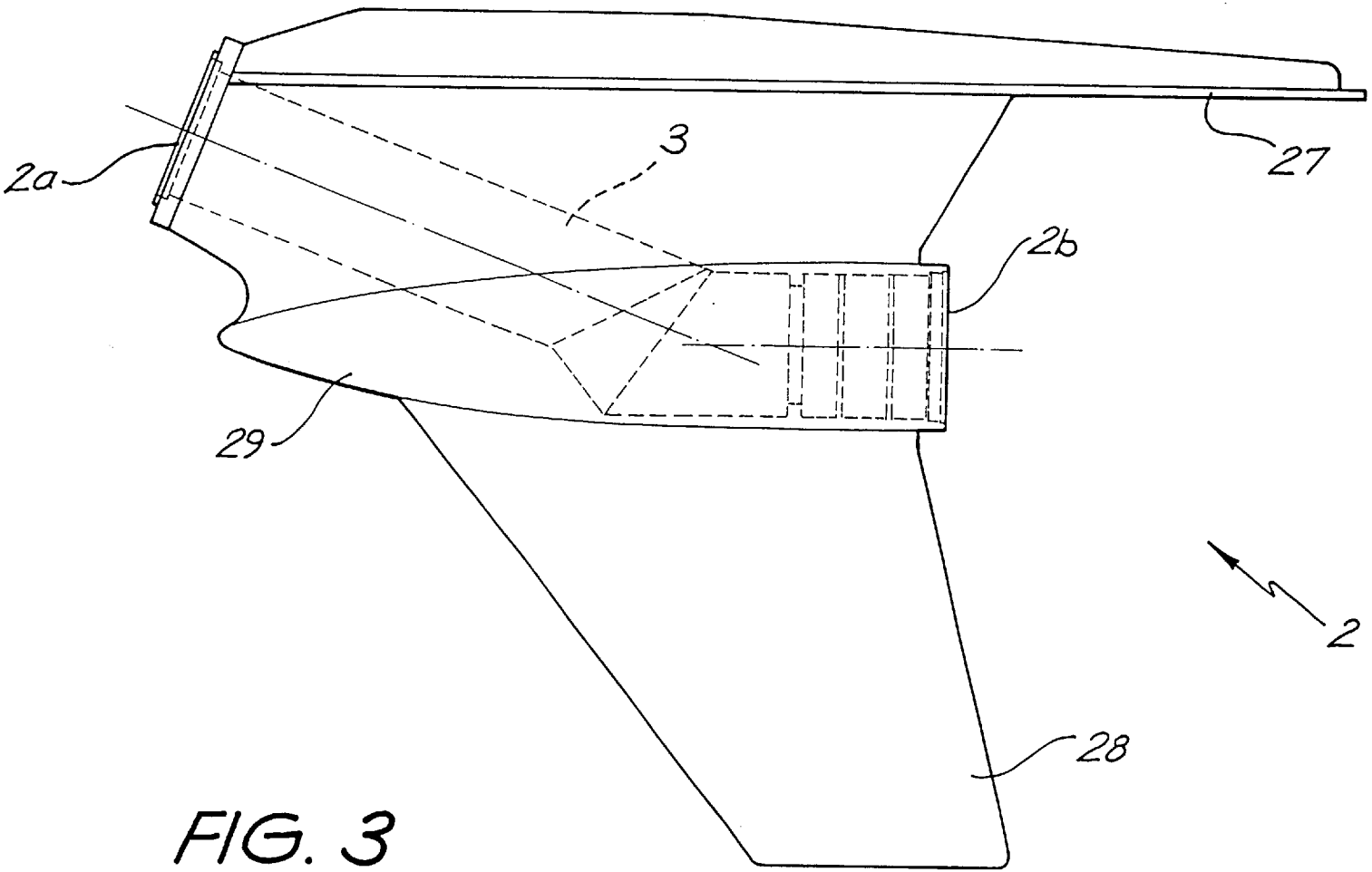
FIG. 3 is side view of the housing of the inboard/outboard boat drive of FIG. 1.

The inboard/outboard boat drive 1 of the preferred embodiment is provided with a housing 2 having first and second ends 2*a*, 2*b* and a cavity 3 passing between the housing first and second ends 2*a*, 2*b*.

The housing first end 2*a* is pivotally mounted on a stern section (transom) 4 of a boat when installed via pivotal mounting means 5, enabling the housing 2 to pivot about a pivot point P.

An input drive shaft 6 having first and second ends 6*a*, 6*b* is adapted to be coupled at its first end 6*a* to an engine (not shown) mounted in the boat. The input drive shaft 6 is typically coupled to the engine through a gearbox or other such transmission, possibly via a half shaft (also known as a jack shaft) which enables soft mounting of the engine on rubber engine mounts.

An intermediate drive shaft 8 having first and second ends 8*a*, 8*b* is disposed within the housing cavity 3 with its first end 8*a* towards the housing first end 2*a* and its second 15 end 8*b* toward the housing second end 2*b*. A first universal joint 9, typically a constant velocity universal joint, couples the input shaft second end 6*b* to the intermediate drive shaft first end 8*a*. The first universal joint 9 is disposed about the pivot point P to enable pivotal movement of the intermediate drive shaft 8 about the pivot point P without jamming when the housing 2 is pivoted.

An output drive shaft 10 having first and second ends 10*a*, 10*b* is coupled at its first end 9*a* to the intermediate shaft second end 8*b* via a second universal joint 11. The second universal joint 11 is also typically a constant velocity universal joint. The output drive shaft second end 8*b* is coupled when installed to a propulsion element such as a propeller 12 which may be a screw propeller or similar. Here the pivotal mounting means 5 comprises a semi-spherical joint 5 in the general form of a ball and socket type arrangement. A semi-spherical female socket member 5*a* of the semi-spherical joint 5 is fastened to the boat stern section 4 via bolts 13 through flange sections 14 of the socket member 5*a*. The socket member 5*a* comprises upper and lower halves which are fastened together via mating flanges on the exterior of each socket member 5*a* half.

A corresponding semi-spherical male ball type member Sb of the semi-spherical joint is provided on the housing first end 2*a* and is captively received in the semi-spherical female socket member 5*a*. Fastening of the two socket member 5*a* halves together about the ball type member 5*b* ensures the ball type member 5*b* is captively held whilst being able to universally pivot within the semi-spherical female socket member 5*a* about the pivot point P. The housing cavity 3 passes through the semi-spherical male ball type member 5*b* at the housing first end 2*a*.

The arrangement could alternatively be configured with a male ball type member being fastened to the stern section 4 and a cooperating female socket member being provided on the housing first end 2*a*.

The arrangement enables mounting of the engine toward the rear of the boat thereby freeing up space toward the center of the boat and providing favorable weight distribution characteristics for planing type hulls.

The input drive shaft 6 is here rotatably mounted on the semi-spherical socket member 5*a* by means of two bearing races 15 disposed within a bearing housing 16. The bearing races 15 utilized in the preferred embodiment are shielded sealed bearing races to minimize maintenance requirements and possible leakage of lubricants. The bearing races 15 are separated within the bearing housing by a tubular spacer 17. The bearing housing 16 is fastened to the semi-spherical socket member 5*a* by means of fasteners 18. The bearing races 15 may alternatively be fixed within the hull of the boat separate from the socket member 5*a*. A flanged coupling member 19 is secured to the first end 6*a* of the input shaft for coupling with the engine output shaft or a jack/half shaft.

The first constant velocity joint 9 is here arranged within the cavity 3 concentrically within the semi-spherical male ball type member 5*b* such that it pivots about the pivot point P. The first constant velocity joint 9 transmits engine torque from the input drive shaft 6 to the intermediate drive shaft 8 through a range of angles between the longitudinal axes thereof as the housing 2 and intermediate drive shaft 8 are pivoted about the pivot point P. A rubber boot 20 encloses the open end of the constant velocity joint to prevent the ingress of foreign matter and the leakage of lubricants. A similar rubber boot 23 is provided at the second constant velocity joint 11.

The output shaft 10 is mounted within the housing cavity 3 toward the second end of the housing 2*b* by bearing races 21 in a similar manner to the input shaft 6. A seal 22 at the outlet of the cavity 3 inhibits the ingress of water into the cavity 3 and prevents the egress of any lubricant therefrom. The propeller 12 is fastened to the second end 10*b* of the output shaft 10 by means of a nut 24 threaded onto the output shaft 10.

The bearing races 21 associated with the output shaft 10 fix the longitudinal axis thereof, keeping it in a fixed relationship to the longitudinal axis of the intermediate drive shaft 8. The second constant velocity joint 11 hence is not required to pivot as per the first constant velocity joint 9, but merely enables transfer of torque at an offset angle between the intermediate drive shaft 8 and output drive shaft 10.

The entire drive assembly hence enables torque to be transmitted from the engine, through the input, intermediate and output drive shafts 6,8,10 to the propeller 12 so as to provide a propulsive force to drive the boat.

Control of the inboard/outboard boat drive 1 is provided in a first embodiment by means of a control lever 25. The control lever 25 is mounted on the semi-spherical ball type member 5*b* via a threaded pin 26 fastened to the ball type member 5*b*. The pin 26 protrudes through an aperture 27 provided in the semi-spherical socket member 5*a* to allow some freedom of movement between the ball and socket members 5*b*, 5*a*. In an alternative embodiment, the lever 25 may be integrally formed with the ball-type member 5*b*. Movement of the control lever 25 results in pivoting of the ball type member 5*b* within the socket member 5*a* about the pivot point P, causing the housing 2 to also pivot about the pivot point P. Rather than utilizing a control lever 25, pivotal movement may be imparted directly to the ball type member 5*b* or directly to the housing 2.

The control lever 25 is attached to control means for pivoting the housing 2 about the pivot point P. Pivoting of the housing 2 in a vertical plane adjusts the angle of attitude of the drive axis of the propeller 12, which corresponds to the longitudinal axis of the output drive shaft 10, with respect to the boat hull, thereby adjusting the trim of the boat. The housing 2 can also be pivoted upward above the lower surface of the hull to enable the boat to be run up on to beaches without damaging the propeller 12. In the preferred embodiment such vertical pivoting is achieved by means of a hydraulic ram. Pivoting of the housing 2 in a horizontal plane provides for steering of the boat. A conventional rack and pinion or cable steering system may be utilized to provide for such steering. The housing 2 may be pivoted in horizontal and vertical planes at the same time to provide for concurrent trim and steering adjustment.

The housing 2 is provided with an anti-cavitation plate 27 and a large rudder 28 to provide for improved steering performance and directional stability. A streamlined, tapered cone fairing 29 is also incorporated into the housing. The fairing extends and tapers toward the front of the housing 2 generally co-axially with the output shaft 10. The fairing aids the maintenance of a streamlined flow of water across the housing 2 and onto the propeller blades at high speed so as to reduce the problem of propeller "blow out".

Figure 4:
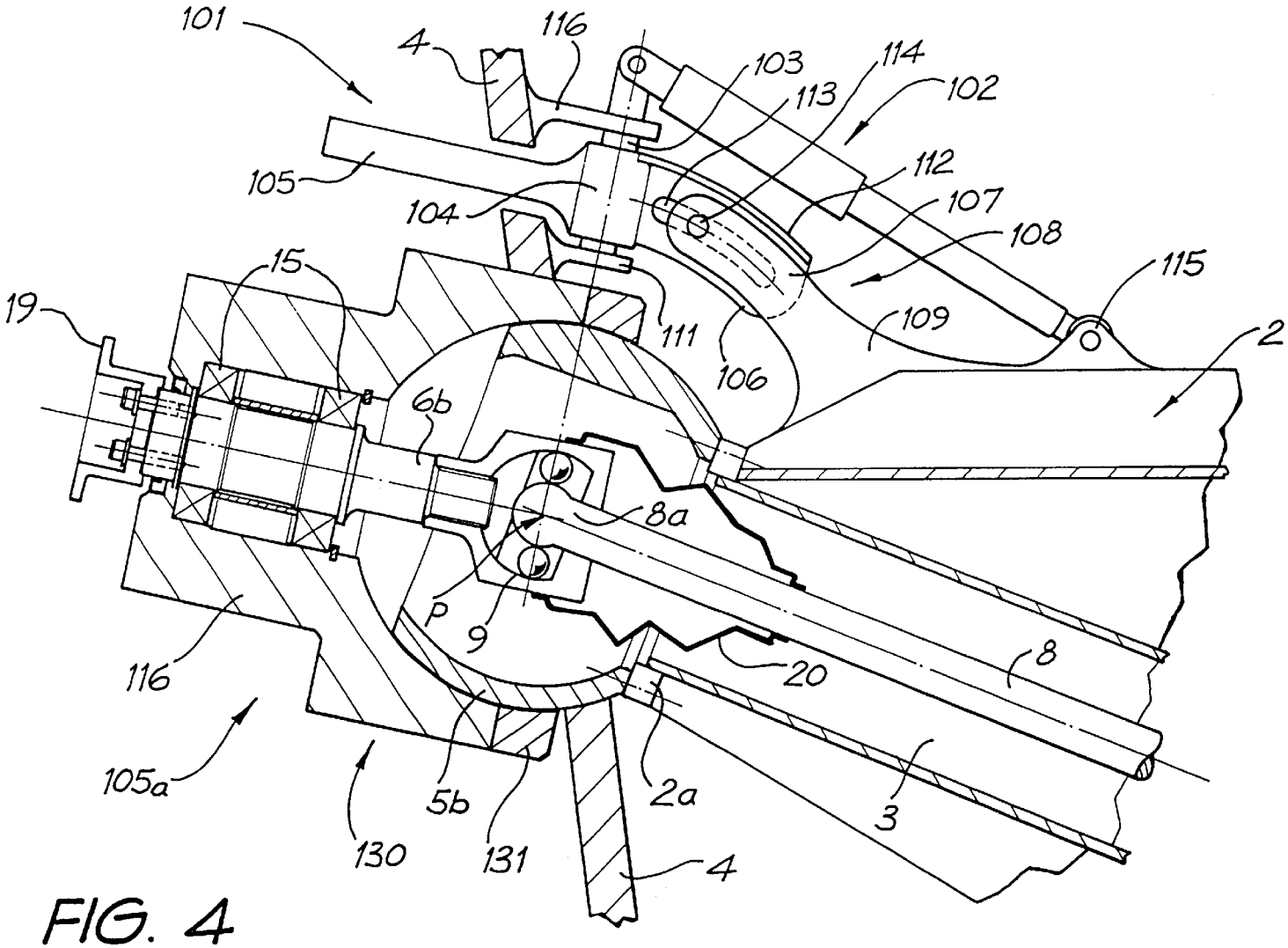
FIG. 4 is a partially sectioned side view of another semi-spherical joint and control mechanism of an inboard/outboard boat drive.

In a second embodiment as depicted in FIG. 4, control of the inboard/outboard boat drive 1 is provided by separate steering and trim control elements 101 and 102 mounted on the housing 2 rather than the semi-spherical ball type member 5*b*. The steering element 101 is pivotally mounted on a pivot pin 103 by means of a bearing 104. A steering control lever 105 extends forward from the bearing 104 through the stern section/transom 4 and into the hull where a steering input is applied to lever 105 to pivot the steering element about the pivot pin 103. A plate 106 extends rearwardly from the bearing 104 and is located between opposing arms 107 of a generally Y shaped fork member 108, the base 109 of which is fixed to the housing 2. Pivoting of the steering element 101 about the pivot pin 103 causes the plate 106 to act upon one of the fork member opposing arms 107 to thereby pivot the housing 2. The pivot pin is mounted on two lugs 110, 111 protruding from the rear of the transom 4 such that an extension of the axis of the pivot pin 103 passes through the pivot point P, thereby enabling steering articulation of the housing 2 about the pivot point P. A stiffening flange 112 is here formed along the top of the 12 mm thick plate 106 to prevent the plate from bending under service loads.

An arcuate slot 113 is provided in the plate 106, the arc defining the center line of the slot 113 being centred at the pivot point P. A pin 114 passes through the slot 113 between the opposing arms 107 of the fork member 108. This arrangement allows the housing 2 to freely pivot in a vertical plane about the pivot point P, trimming the drive, without jamming the steering mechanism.

Trim control is achieved by means of the trim control element 102 which is here a hydraulic telescoping ram. the upper end of the hydraulic ram 102 is attached to an extension of the pivot pin 103, whilst the lower end is attached to the housing 2 by means of a lug and pin arrangement 115. Retraction of the ram 102 raises the housing 2 whilst extension of the ram lowers the housing 2.

The embodiment of FIG. 4 also depicts an alternate form of semi-spherical female socket member 105*a*. The socket member 105*a* has a main body 130 moulded in a single piece, here from an engineering plastics material such as acetal plastic. The main body 130 incorporates a bearing housing portion 116 for the bearing races 15. The main body 130 forms a hemisphere in which the male ball type member 5*b* may be inserted, before securing a ring 131 of the socket member 105*a* to the open end of the main body 130 over the ball type member 5*b*, thereby captively holding the ball type member 5*a* within the socket member 105*a*.

What is claimed is:

1. An inboard-outboard boat drive for mounting on a boat, said drive comprising:

a housing having a first end, a second end and a cavity passing between said housing first and second ends;

pivot means mountable on the stern section of the boat for pivoting said housing first end on the stern section of the boat, enabling pivotal movement about a pivot point with the pivot means mounted on the boat;

an input drive shaft having first and second ends, said first end being adapted to be coupled to an engine mounted in said boat;

an intermediate drive shaft disposed within said cavity and having a first end towards said housing first end and a second end towards said housing second end;

first joint means, comprising a first constant velocity joint, for coupling said input drive shaft second end to said intermediate drive shaft first end; said first joint being disposed about said pivot point to enable pivotal movement of said intermediate drive shaft about said pivot point;

an output drive shaft having first and second ends, said output drive shaft second end being adapted to be coupled to a propulsion element;

second joint means, comprising a second constant velocity joint, for coupling said intermediate shaft second end to said output shaft first end and for enabling transfer of torque at an offset angle between the intermediate drive shaft and the output drive shaft; and bearing means disposed between the housing and the output shaft for mounting the output shaft in the housing and for maintaining the output shaft in a fixed relationship to a longitudinal axis of the intermediate drive shaft.

2. The inboard-outboard boat drive of claim 1, wherein said pivot means comprises a spherically shaped joint in the general form of a ball and socket arrangement.

3. The inboard-outboard boat drive of claim 2 wherein said spherically shaped joint includes:

a spherically shaped female socket member provided at said housing first end and adapted to be fastened to said stern section, and a spherically shaped male ball member disposed within said spherically shaped socket member, and further wherein said cavity passes through said spherically shaped male ball member such that said first joint is generally concentrically positioned within said spherically shaped male ball member and about said pivot point.

4. The inboard-outboard boat drive of claim 1 wherein separate steering and trim control elements are mounted on said housing for steering and trim control.

5. The inboard-outboard boat drive of claim 4 wherein said trim control element is a hydraulic ram.

6. The inboard-outboard-boat drive of claim 3 wherein a control lever is mounted on said spherically shaped member for steering and/or trim control.

7. The inboard-outboard boat drive of claim 4 wherein said input shaft is mounted in bearings disposed within a bearing housing fastened to, or integral with, said spherically shaped female socket member.

8. The inboard-outboard boat drive of claim 1 wherein said output shaft is mounted in bearings disposed within said cavity towards said housing second end.

9. The inboard-outboard boat drive of claim 1 wherein a seal is provided in said cavity at said housing second end.

10. A boat comprising a bow section, a stern section, an engine, a propulsion element and the inboard-outboard drive of claim 1, the housing first end of the drive being pivotally mounted on the stern section of the boat at the pivot means, the first end of the input drive shaft being coupled to the engine, and the output drive shaft second end being coupled to the propulsion element.

* * * * *